US006802088B1

(12) United States Patent
Gruner

(10) Patent No.: US 6,802,088 B1
(45) Date of Patent: Oct. 12, 2004

(54) COMFORT BED BATH

(76) Inventor: Daniel M Gruner, P.O. Box 760, Wofford Heights, CA (US) 93285

( * ) Notice: Subject to any disclaimer, the term of this patent is extended or adjusted under 35 U.S.C. 154(b) by 0 days.

(21) Appl. No.: 10/331,253

(22) Filed: Dec. 30, 2002

(51) Int. Cl.[7] ..... A47K 3/02

(52) U.S. Cl. ..... 4/555; 4/574.1; 4/575.1; 4/584

(58) Field of Search ..... 4/555, 556, 573.1, 4/574.1, 575.1, 584, 592

(56) References Cited

U.S. PATENT DOCUMENTS

| | | | | | |
|---|---|---|---|---|---|
| 139,819 | A | * | 6/1873 | Russell, Jr. | 4/574.1 X |
| 2,576,623 | A | | 11/1951 | McLaughlin | 4/555 |
| 3,559,216 | A | | 2/1971 | Kyte | 4/555 X |
| 4,170,045 | A | | 10/1979 | Estes | 4/592 X |
| 4,207,629 | A | | 6/1980 | Kagawa | 4/540 |
| 4,432,104 | A | * | 2/1984 | Sasaki | 4/555 |
| 4,485,502 | A | | 12/1984 | Marcanio | 4/585 |
| 4,713,850 | A | | 12/1987 | Flaherty et al. | 4/592 |
| 5,025,515 | A | | 6/1991 | Rhines | 4/584 X |
| 5,054,136 | A | | 10/1991 | Inagaki | 4/546 |
| 5,341,526 | A | | 8/1994 | Kennedy | 4/584 |
| 5,598,590 | A | | 2/1997 | Crawford et al. | 4/540 |
| 5,701,614 | A | | 12/1997 | Appleford et al. | 4/555 |
| 5,819,333 | A | | 10/1998 | Coleman | 4/575.1 X |

* cited by examiner

*Primary Examiner*—Robert M. Fetsuga
(74) *Attorney, Agent, or Firm*—Michael I Kroll

(57) ABSTRACT

The present invention 10 discloses a portable bed device comprising a horizontal bottom 26 surrounded by vertical walls 28 with an open top forming a tub 32 for holding water therein in order to wash a person. The tub 32 has a removable side panel 42 incorporated into at least one sidewall wherein a latching mechanism 44 is used to attach the removable side panel to the tub 32. An adjustable backrest/footrest 38 is provided in order to rest the patient's head thereon wherein the backrest/footrest element is attached by tongue 39 and groove 40 fastening means to the sidewalls of the tub 32. A headrest 48 may also be removably attached to the backrest/footrest element. A means for introducing water into the tub 32 comprises a flexible inlet conduit 18 and a flexible outlet conduit 20 wherein water may be supplied from a conventional household showerhead and diverted back for discharge into, for example, the shower or tub 33 itself The patient may be washed using the showerhead 36 attached to the end of the inlet line 18. The tub 32 may be placed onto a gurney 16 when it is not feasible to bathe the patient in the bed.

14 Claims, 7 Drawing Sheets

COMFORT BED BATH

BACKGROUND OF THE INVENTION

1. Field of the Invention

The present invention relates generally to portable bath devices and, more specifically, to a portable bathing unit fabricated of a sturdy, rigid, lightweight material wherein said portable bathing unit comprises a base member having a horizontal bottom surrounded by vertical walls with an open top forming a basin in which to bathe a person that is infirm, injured or otherwise in need of assisted bathing.

The present invention further comprises a means for introducing water into the basin for washing the person therein and a means for draining the water therefrom. A removable side panel is incorporated in at least one sidewall of said base member to ease the transferal of a patient therein and therefrom and is secured to said base member by latching mechanisms that in conjunction with an EPDM seal assure a watertight seal. The latching mechanisms may also be adjustable to allow the user to increase the tension accordingly to compensate for any deformities occurring to the sidewall or base member after a period of use to maintain the water tight seal.

Furthermore, an adjustable backrest/footrest element is provided which can be selectively placed within said basin according to the needs of the individual within. A tongue and groove fastening method is the preferable means for adjustably retaining said backrest/footrest element in a specific position within the basin although other suitable backrest retaining means may be utilized. A headrest may be removably fastened by an attachment means such as hook and loop fasteners to the backrest/footrest element or the top of the end sidewalls to provide comfort and safety to the patient depending upon the needs of the patient and the type of bath they are receiving.

The means for introducing water into the basin comprises a flexible conduit, a means for fastening said flexible conduit to a pressurized water source, and a means for manually restricting and controlling the flow of fluid from said flexible conduit. In the preferred embodiment of the present invention the water source is a conventional household shower head and the water source fastening means is a threaded diverter element that threads onto the shower neck when the shower head is removed therefrom. The flexible conduit is a shower hose connected to said diverter element on one end and to the fluid restricting means on the other with said fluid restricting means being a hand-held shower head. The hand-held shower head comprises a means for connecting to said shower hose, a handle member, a plurality of dispersion recesses for diffusing the ejaculation of the fluid as it passes therethrough and a means for manually regulating the pressure and quantity of water introduced to the patient. The showerhead may also be equipped with a trickle drip system that will prevent the water regulating means from completely restricting the flow of water through the shower head thereby preventing backpressure from causing undue stress to the internal components therein.

The drainage means comprises a drain assembly and a discharge hose that could thread onto the drain assembly, said drain assembly comprising a passage communicating between the floor of the internal basin portion of said base member and a spigot incorporated with the base member threaded to correspond with the threads of said discharge hose. The discharge line could be run to a bathtub, shower enclosure or any other suitable area to receive waste water that is at a level lower than that of the drain assembly. The spigot may be completely open during washing thereby providing more of a shower as the water is drained from the basin as rapidly as it is introduced or it may be partially closed to allow the patient to remain immersed while the shower head is continually introducing water therein. The spigot may also be closed to allow the basin to be filled to a selected depth and used strictly as a bath. Once the bathing is complete the drain is fully opened, the water is drained completely, the patient rolled back onto the bed, and the tub is removed.

A gurney is provided for supporting the bathing unit when it is not feasible or allowed to bathe the patient on the bed. The top portion of the gurney's frame fits inside corresponding cannels located on the underside of the bathing unit to maintain it securely.

2. Description of the Prior Art

There are other portable bath devices. Typical of these is U.S. Pat. No. 2,576,623 issued to Mclaughlin on Nov. 27, 1951.

Another patent was issued to Kyte on Feb. 2, 1971 as U.S. Pat. No. 3,559,216. Yet another U.S. Pat. No. 4,170,045 was issued to Estes on Oct. 9, 1979 and still yet another was issued on Jun. 17, 1980 to Kagawa as U.S. Pat. No. 4,207,629.

Another patent was issued to Marcanio on Dec. 4, 1984 as U.S. Pat. No. 4,485,502. Yet another U.S. Pat. No. 4,713,850 was issued to Flaherty et al. on Dec. 22, 1987 and still yet another was issued to Rhines on Jun. 25, 1991 as U.S. Pat. No. 5,025,515 and Inagaki was issued U.S. Pat. No. 5,054,136 on Oct. 8, 1991. U.S. Pat. No. 5,341,526 was issued on Aug. 30, 1994 to Kennedy and on Feb. 4, 1997 Crawford et al. was issued U.S. Pat. No. 5,598,590. Appleford et al. was issued U.S. Pat. No. 5,701,614 on Dec. 30, 1997 and on Oct. 13, 1998 Coleman was issued U.S. Pat. No. 5,819,333.

U.S. Pat. No. 2,576,623

Inventor: Bernard E. McLaughlin

Issued: Nov. 27, 1951

A bathing apparatus comprising a portable and collapsible tub stand, a tub hingedly secured to said stand and one of the side walls of said tub being hinged so that a patient may be moved into the tub through the opening formed in the tub by the opening formed in the tub by opening the side of the tub.

U.S. Pat. No. 3,559,216

Inventor: Dorothy F. Kyte

Issued: Feb. 2, 1971

A portable bathtub for use with bed patients that comprises a basin with a bottom wall and an upstanding end and longitudinal side walls surrounding the bottom wall, the bottom wall the bottom wall and one longitudinal side wall being joined by an externally convex, curved wall section of relatively large radius forming a rocker support along the corresponding lower longitudinal corner portion of the tub whereby the tub can be rotated transversely on the rocker support afforded by said curved wall to place a patient in the tub without lifting the patient.

U.S. Pat. No. 4,170,045

Inventor: Judith K. Estes

Issued: Oct. 9, 1979

A contoured inner bathing tub or litter having a multiplicity of perforations or apertures formed therein is removably positioned within a complementarily contoured outer tub. The outer tub is supported on a mobile frame. The present invention permits a patient to be easily positioned on the litter and, then, bathed while resting stationary and in a natural position within the inner tub. The perforations enable the bathing liquid to enter the litter for washing the patient.

U.S. Pat. No. 4,207,629

Inventor: Hideo Kagawa

Issued: Jun. 17, 1980

A tub-bathing equipment for bedridden old people, physically-handicapped people and so on, in which a bathtub fitted into a rectangular frame of a carriage from above is slanted by a crane disposed under the bathtub so that the side of the shallowest portion of the bathtub is lowered to the floor to allow ease in helping the patient into or out of the bathtub.

U.S. Pat. No. 4,485,502

Inventor: Louis Marcanio

Issued: Dec. 4, 1984

A portable bathing tub for invalids, especially bed-ridden persons. There is a large waterproof sheet which is laid on one half of the width of the bed, while the person rolls to the other half Then the person rolls onto the half where the sheet has been placed, and the remainder of the sheet is extended over the second half of the bed, and the margins are gathered up close to or onto the person when the person is approximately centered on the bed. A frame of four L-shaped members, preferably made of plastic material, is erected to form a rectangular enclosure of low walls around the person. The edges of the waterproof sheet are then placed against these low walls and extend up the inside surfaces of the walls and are folded over the top edges of the walls, held there by spring clips. Water is then added to this shallow tub, so the person may bathe or be bathed. An outlet conduit allows the water to be drained when the bath is completed. A by-pass around a valve in the outlet conduit rises to an elevation slightly below the top edge of the tub walls, so as to retain water (up to this elevation) when the valve is closed, but to allow excess water to pass out through the by pass if the tub is accidentally filled too close to the top edge of the tub walls. The L-shaped members are easily disassembled for storage between baths.

U.S. Pat. No. 4,713,850

Inventor: Patrick Flaherty et al.

Issued: Dec. 22, 1987

An improved portable bathing apparatus useful for washing toxic substances from a patient in a prone position includes a support platform mounted on a support frame, a circumferential rail with a sheet attached to the rail, the rail being movable between a position parallel with the table to a position above the table to define a vessel. Specialized liners may be positioned within the vessel for use when bathing a patient to wash toxic substances therefrom. A stretcher with a special stainless steel construction and configuration is provided for support of a patient within the vessel.

U.S. Pat. No. 5,025,515

Inventor: Michael Rhines

Issued: Jun. 25, 1991

A portable bath tub apparatus 10 is provided for facilitating the bathing of bedridden persons. The portable bath tub apparatus 10 includes an inflatable bath tub 16. An air pump 60 and tank 61 are provided to inflate the bath tub 16. A movable water storage tank 40 is coupled to the bath tub 16 by a water pump 46 which facilitates the movement of water from the tank to the bath tub 16. A heat dispenser 56 is provided to heat the water in the tank 40 so that the water in the bath tub 16 can be maintained at a desired temperature.

U.S. Pat. No. 5,054.136

Inventor: Jitsuo Inagaki

Issued: Oct. 8, 1991

A bed capable of allowing a patient such as the aged confined in a bed to take a bath easily and without much trouble to a nurse attending to the patient. According to a feature of the bed, a bath-tub is slidably mounted at the lower portion of the bed, the bath-tub having a mat disposed therein, said mat being movable up and down within the bath-tub with a human body laid thereon. The bed is provided with a tilting mechanism for easily transferring a patient from the bed to the mat, the mat also capable of being tilted by a suitable mechanism so that the human body may be easily transferred from the mat to the bed.

U.S. Pat. No. 5,341,526

Inventor: Linda J. Kennedy

Issued: Aug. 30, 1994

An apparatus for the hygiene care of a person confined to a bed, comprising an inflatable tub with two cavities therein that is easily placed under a person and inflated. The device is equipped with separate drains and aprons which create pockets that contain disposable waste water bags which retrieve all waste water from the bed. The inflatable bed is supplied with water and air from a free-moving service apparatus. The inflatable bed and service apparatus are integral parts and together provide a practical and convenient method to administer personal hygiene care to a person confined to a bed.

U.S. Pat. No. 5,598,590

Inventor: Michael K. Crawford et al.

Issued: Feb. 4, 1997

A portable bath tub (20, 20A, 20C) and a supporting frame (46, 17A, 200) for the bath tub (20, 20A, 20C) are positioned alongside a bed (10, 10A, 10C). The bath tub (20, 20A, 20C) has a front side (76) which overlaps a mattress (12, 12A, 12C) on the bed (10, 10A, 10C) and is supported thereby. The tub (20, 20A, 20C) bridges the bed (10, 10A, 10C) and the supporting frame. The bed (10B) has a bed frame (14B) which is movable vertically for raising and lowering the bath tub (20) which is partially supported on the mattress (12B).

U.S. Pat. No. 5,701,614

Inventor: David E. Appleford

Issued: Dec. 30, 1997

A bath (1) for use by an elderly or disabled person. The bath (1) includes a side opening (3) which extends over the full width and height of the bath (1) and is surrounded by and outwardly and downwardly extending skirt (8). A door (4) with a channel (9) on its inner surface is upwardly translatable in its own plane to bring the door (4) over the opening (3) and force the skirt (8) into sealing engagement with a seal (11, 40) in the channel (9) which may be a foamed rubber seal or a part fluid-filled flexible tube up which the fluid is squeezed to effect sealing in upper portions of the tube as closing is completed.

U.S. Pat. No. 5,819,333

Inventor: Jill Coleman

Issued: Oct. 13, 1998

A portable, inflatable, one-person vessel for recumbent, weightless, therapeutic flotation of a sufferer features a plurality of substantially vertical inflatable compartments attached to a waterproof floor. Each of the inflatable compartments is interconnected in pneumatic communication with the other inflatable compartments. Each inflatable compartment is in contact with adjacent inflatable compartments. The portable, inflatable vessel can be erected around a person suffering from pathology such as back spasm, sciatic nerve pain, arthritis, etc., and who cannot or should not be moved, or for a person who does not have access to a therapeutic pool. The flotation vessel provides a weightless environment for relief of pain caused by weight of body, constriction of joints, pressure, muscle spasm or tension, nerve pain, and etc.

While these portable bath devices may be suitable for the purposes for which they were designed, they would not be as suitable for the purposes of the present invention, as hereinafter described.

SUMMARY OF THE PRESENT INVENTION

The present invention discloses a portable bed device comprising a horizontal bottom surrounded by vertical walls with an open top forming a basin for holding water therein in order to wash a person. The tub has a removable side panel incorporated into at least one sidewall wherein a latching mechanism is used to attach the removable side panel to the tub. An adjustable backrest/footrest is provided in order to rest the patient's head thereon wherein the backrest/footrest element is attached by tongue and groove fastening means to the sidewalls of the tub. A headrest may also be removably attached to the backrest/footrest element. A means for introducing water into the tub comprises a flexible inlet conduit and a flexible outlet conduit wherein water may be supplied from a conventional household showerhead and diverted back for discharge into, for example, the shower itself. The patient may be washed using the showerhead attached to the end of the inlet line. The showerhead may also be equipped with a trickle-drip system. The tub may be placed onto a gurney when it is not feasible to bathe the patient in the bed.

A primary object of the present invention is to provide a portable bed bath unit that will permit the infirm, elderly or otherwise incapacitated person in need of assistance to receive a full bath on their bed or on a gurney.

Another object of the present invention is to provide a portable bed bath unit that is rigid and lightweight to allow a single caregiver to put the present invention on the bed and transfer the patient therein.

Yet another object of the present invention is to provide a portable bed bath unit having a removable sidewall for easy patient transferal between the bed or a wheelchair and the present invention.

Another object of the present invention is to provide a portable bed bath unit wherein the bathing area may be sized accordingly for children and different sized adults through the use of an adjustable backrest that may be secured within a plurality of positions within the tub.

Still yet another object of the present invention is to provide a portable bed bath unit having a hand-held shower head having a substantially long hose for receiving water from a water source such as a conventional shower head and a drain assembly and discharge hose for removing water therefrom.

Another object of the present invention is to provide a portable bed bath unit having a gurney to support the bathing unit, the height of the gurney could be the height of a bed or of a wheelchair.

Yet another object of the present invention is to provide a portable bed bath unit that is inexpensive to manufacture and operate.

One more object of the present invention is to provide a portable bed bath unit that is simple to use.

Additional objects of the present invention will appear as the description proceeds.

The present invention overcomes the shortcomings of the prior art by providing a portable bed bath unit that is lightweight and rigid and has a removable sidewall that when removed provides an accessible entryway for transferal of a patient therethrough. The shower head connects to a water source and has a pressure release trickle system to prevent excessive back pressure. A gurney is provided to support the bathing unit when unable to bathe the patient on the bed.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

BRIEF DESCRIPTION OF THE DRAWING FIGURES

In order that the invention may be more fully understood, it will now be described, by way of example, with reference to the accompanying drawings in which.

LIST OF REFERENCE NUMERALS

Figure 1:
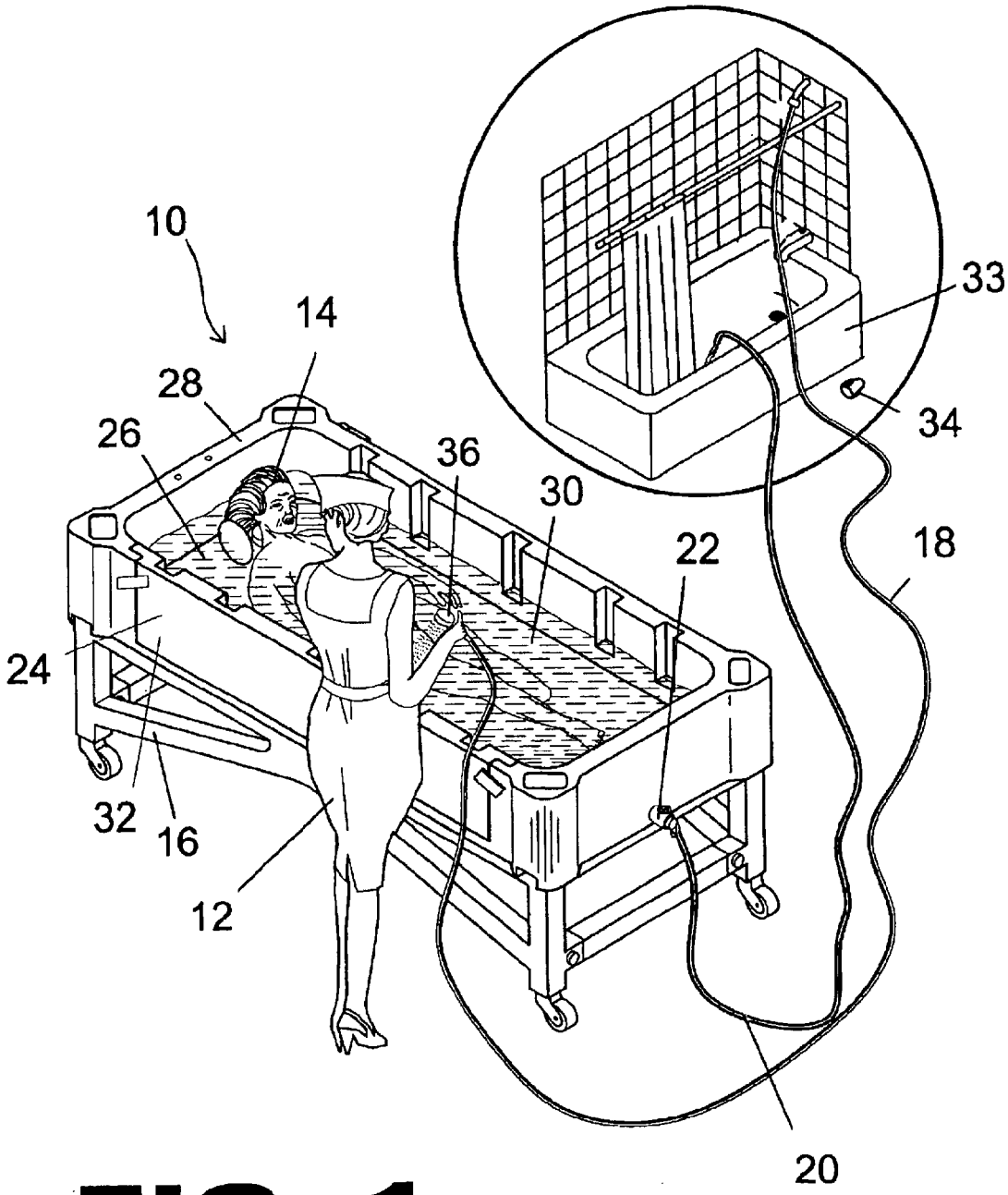
FIG. 1 is an illustrative view of the present invention in use.

With regard to reference numerals used, the following numbering is used throughout the drawings.

10 present invention
12 caregiver
14 patient
16 gurney
18 inlet line
20 outlet line
22 drain assembly
24 base member
26 bottom
28 walls
30 water
32 tub
33 tub
34 original showerhead
36 showerhead
38 backrest/footrest
39 tongue
40 groove
42 removable side wall
44 latching mechanism
46 hand grip
48 headrest
50 attachment means
52 spigot
53 EPDM
54 EPDM seal
56 bottom retaining flange
58 side retaining flange
60 bottom retaining flange
62 side retaining flange
64 hose connection
66 flow regulation trigger
68 outlet recesses
70 wheels of gurney

DETAILED DESCRIPTION OF THE PREFERRED EMBODIMENTS

The following discussion describes in detail one embodiment of the invention and several variations of that embodiment. This discussion should not be construed, however, as limiting the invention to those particular embodiments. Practitioners skilled in the art will recognize numerous other embodiments as well. For a definition of the complete scope of the invention, the reader is directed to the appended claims.

Turning to FIG. 1, shown therein is an illustrated view of the present invention 10 in use. The present invention 10 is a portable, rigid bath unit that allows a caregiver 12 to give a patient 14 a full bath on their bed (not shown) or on a gurney 16 as shown. An inlet shower hose line 18 and outlet discharge hose line 20 are provided for introducing and removing water from the bath area. The discharge hose line 20 is shown connected to the drain assembly 22, which for illustrative purposes is shown projecting from the base member 24 but is preferably recessed therein to reduce the risk of damage due to incidental contact. The hoses are of a substantial length to allow the caregiver 12 to give the patient 14 a bath without having to move them. The base member 24 comprises a horizontal bottom 26 surrounded by vertical walls 28 with an open top forming a basin or tub 32 therein for holding water 30 in which to bathe a person that is infirm, injured or otherwise in need of assisted bathing. Also shown are an original tub 33 shower head 34 removed and a shower head 36 in the hands of the caregiver 12.

Figure 2:
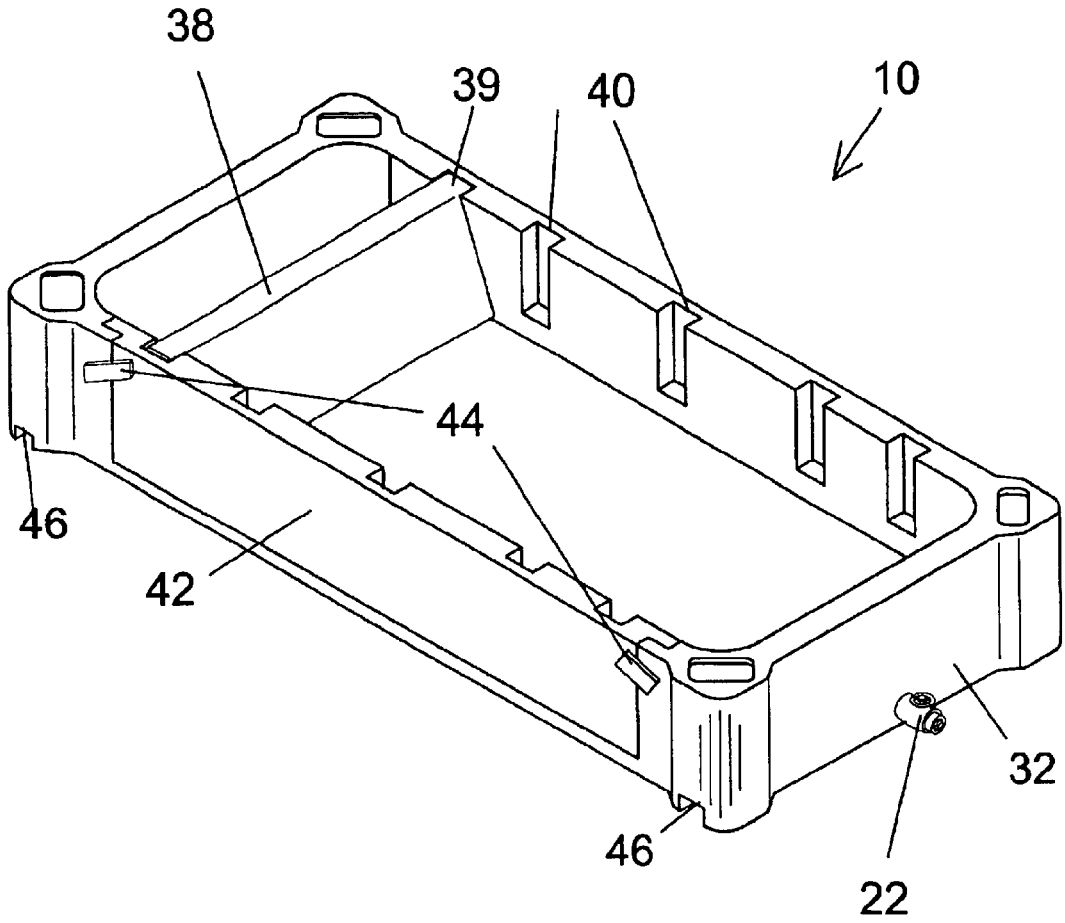
FIG. 2 is a front perspective view of the present invention.

Turning to FIG. 2, shown therein is a front perspective view of the present invention 10, being a bed bath unit having two sidewalls and two end walls with a removable sidewall 42 that allows a caregiver to easily roll the patient back and forth from the bed or a wheelchair and into the bath. An adjustable backrest/footrest element 38 is provided which can be selectively placed within the tub or basin 32 according to the needs of the individual within. A tongue 39 on each end of the backrest/footrest 38 and groove 40 on the inner surface of the sidewalls is the preferred fastening method or means for adjustably retaining the backrest/footrest element 38 in a specific position within the basin 32 although other suitable backrest retaining means may be utilized. A removable side panel 42 is incorporated in at least one sidewall of base member 32 to ease the transferal of a patient therein and therefrom and is secured to the base member 32 by latching mechanisms 44 that in conjunction with an EPDM (ethylene, propylene, diene membrane) seal assure a watertight seal. The latching mechanisms 44 may also be adjustable to allow the user to increase the tension accordingly to compensate for any deformities occurring to the sidewall 42 or base member 32 after a period of use to maintain the water tight seal. Also shown are hand grips 46 and drain assembly 22.

Figure 3:
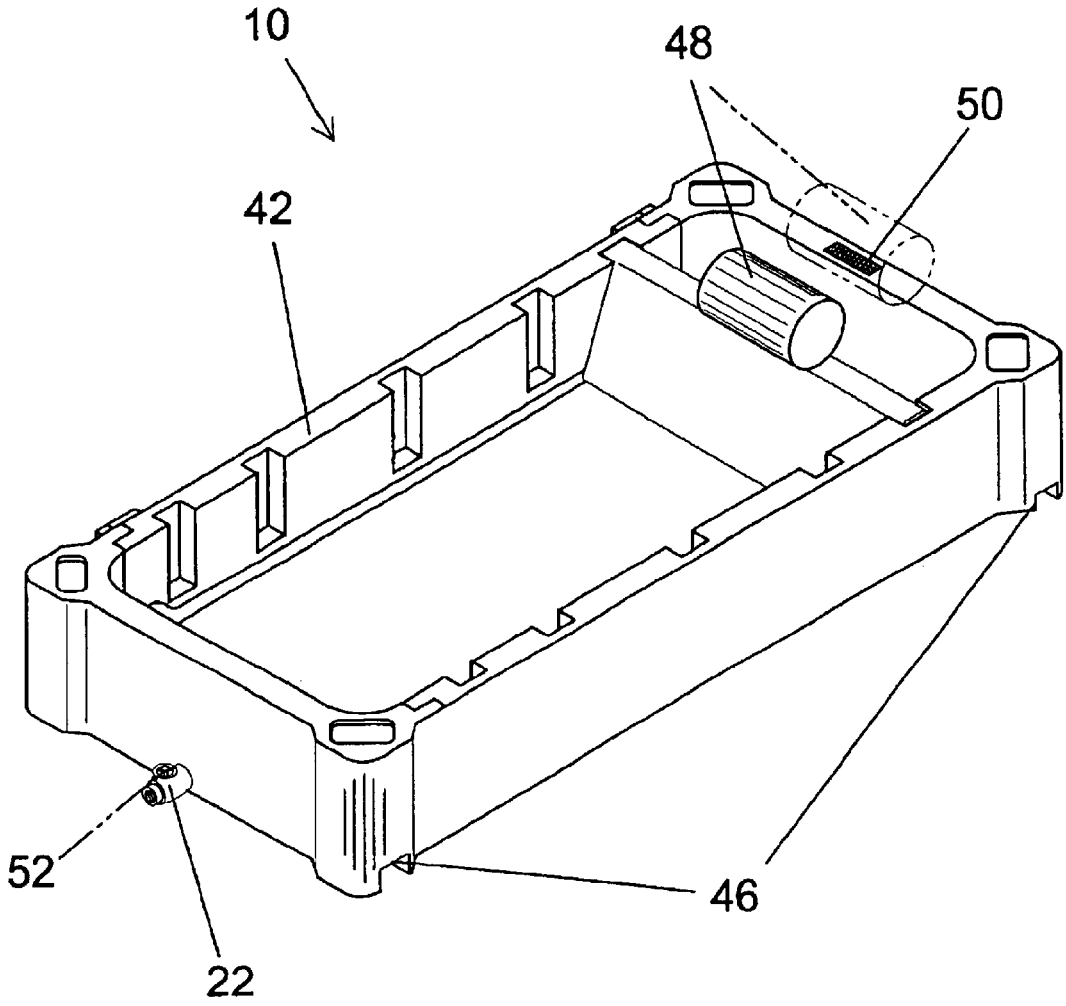
FIG. 3 is a rear perspective view of the present invention.

Turning to FIG. 3, shown therein is a rear perspective view of the present invention 10 with an optional, removable headrest 48. An attachment means 50 such as hook and loop fastening elements allows for selectively placing the headrest 48 in any one of a plurality of positions, one of which is illustrated in phantom line. The headrest 48 may come in any number of shapes and configurations to satisfy the needs of paraplegics and other patients with special needs. The present invention may also be adapted to accommodate other appropriate accessories that may be needed to increase the comfort level of patients with special needs. Also shown are the removable sidewall 42, drain assembly 22 with spigot 52 and the recessed hand grips 46.

Figure 4:
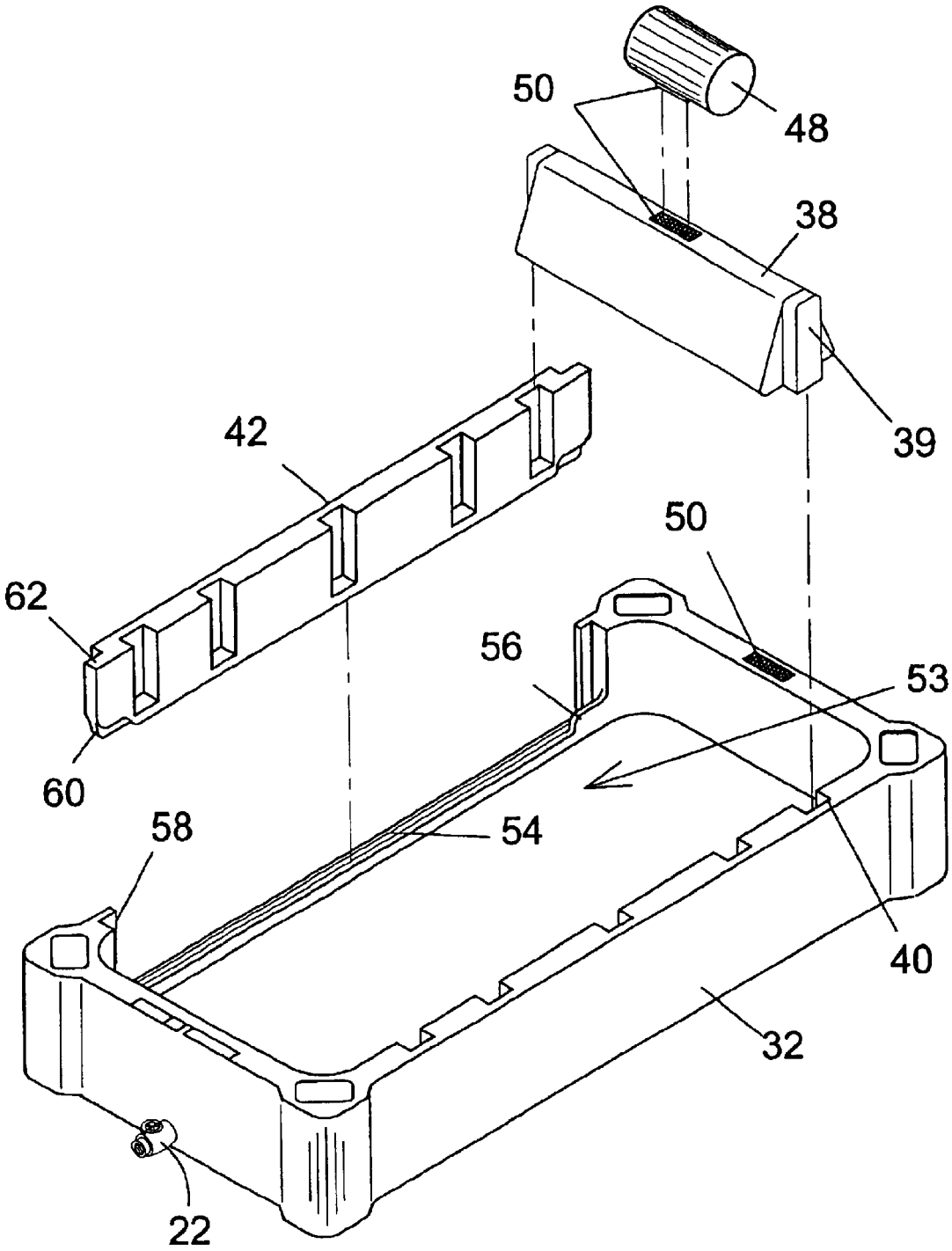
FIG. 4 is an exploded perspective view of the present invention.

Turning to FIG. 4, shown therein is an exploded perspective view of the present invention 10. Shown in FIG. 4 are the various means for securing the removable sidewall 42 and some of the potential accessory items. The removable sidewall 42 slides vertically into place where it is maintained flush with the portion of the sidewall 56, 58 that is formed into the base member 32 by a combination of various retaining flanges and an EPDM 53 and seal 54 (a tripolymer membrane of ethylene, propylene and diene) to form a watertight seal. Once in place, the removable sidewall 42 is prohibited from moving by latch members (not shown in this figure) on the exterior portion of the base member 32 and the removable sidewall 42 thereby forming a watertight seal therebetween. Also shown are the vertical bottom 56 and horizontal side 58 retaining flange of the base member 32 and the vertical bottom 60 and horizontal side 62 retaining flange of sidewall 42. The vertical flange 56, 60 mate and the horizontal flanges 58, 62 mate. Also shown are the headrest 48, backrest 38 with sloping front and rear faces, hook and loop fastening elements 50, backrest retaining tongue 39 and retaining groove 40 and drain assembly 22.

Figure 5:
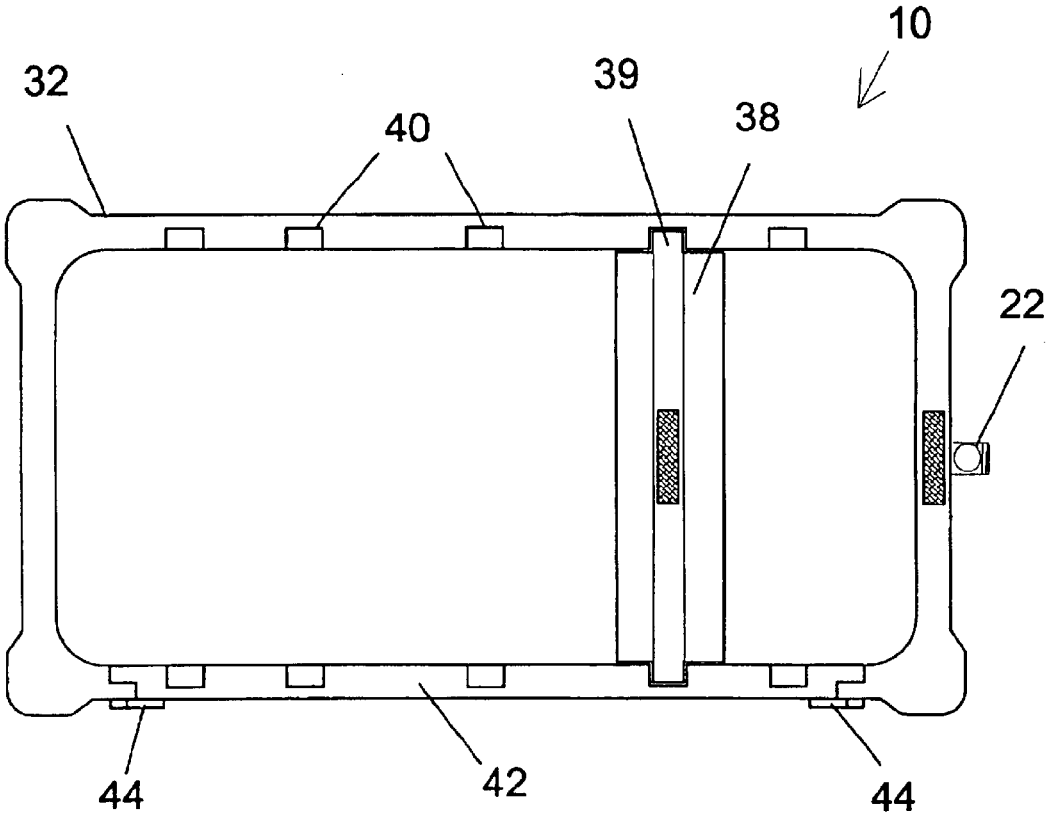
FIG. 5 is a top view of the present invention.

Turning to FIG. 5, shown therein is a top view of the present invention 10 showing the backrest 38 adjusted to accommodate a smaller and shorter patient. Other elements previously disclosed are also shown.

Figure 6:
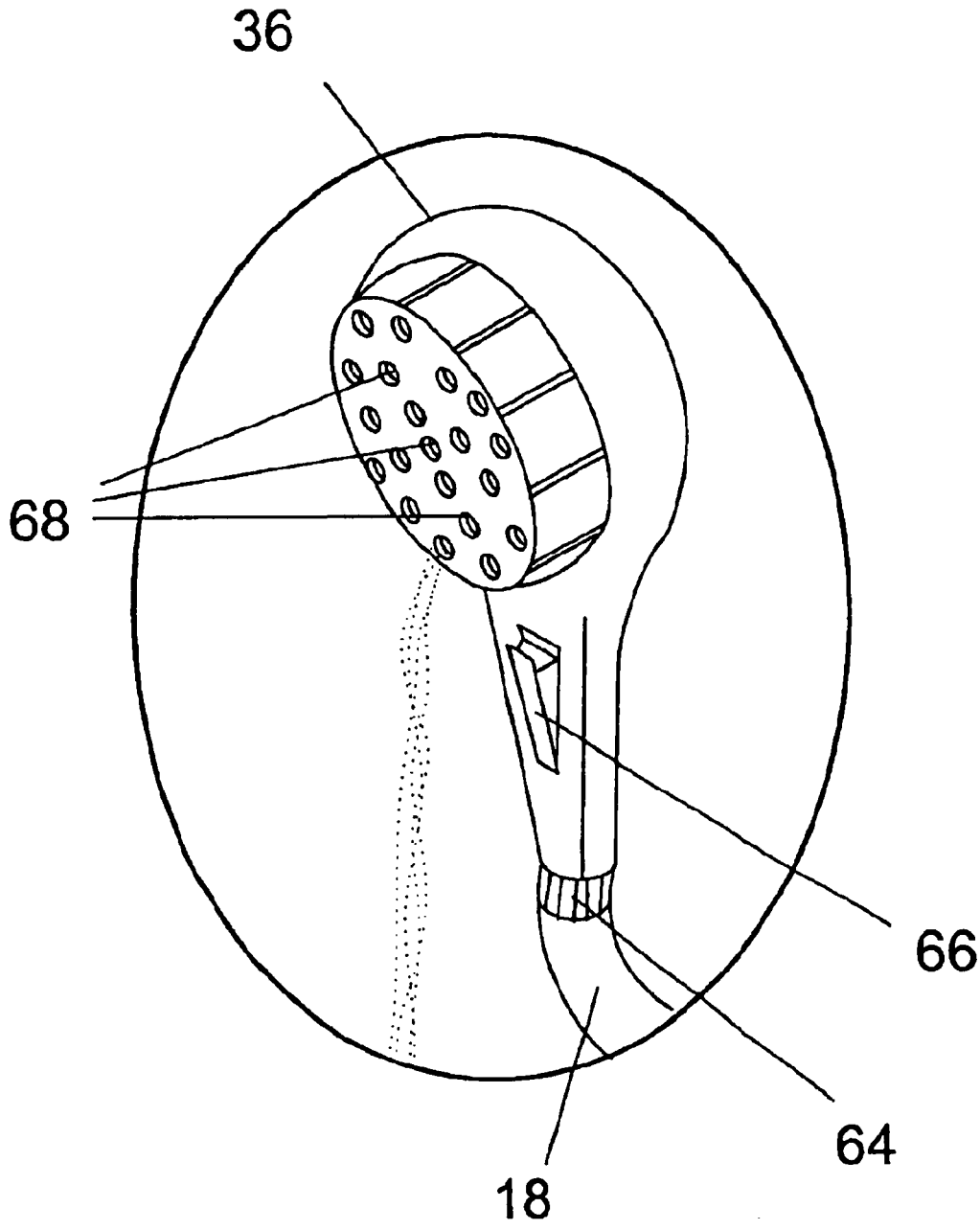
FIG. 6 is a perspective view of the hand-held showerhead of the present invention.

Turning to FIG. 6, shown therein is a perspective view of the hand-held showerhead 36 of the present invention which includes a trickle drip system that will prevent the shower head from totally restricting the flow of water in order to maintain the integrity of internal components that might otherwise be adversely affected by a build-up of back pressure. Also shown is the inlet hose 18, hose connection means 64, flow regulation trigger 66 and dispersion or outlet recesses or apertures 68.

Figure 7:
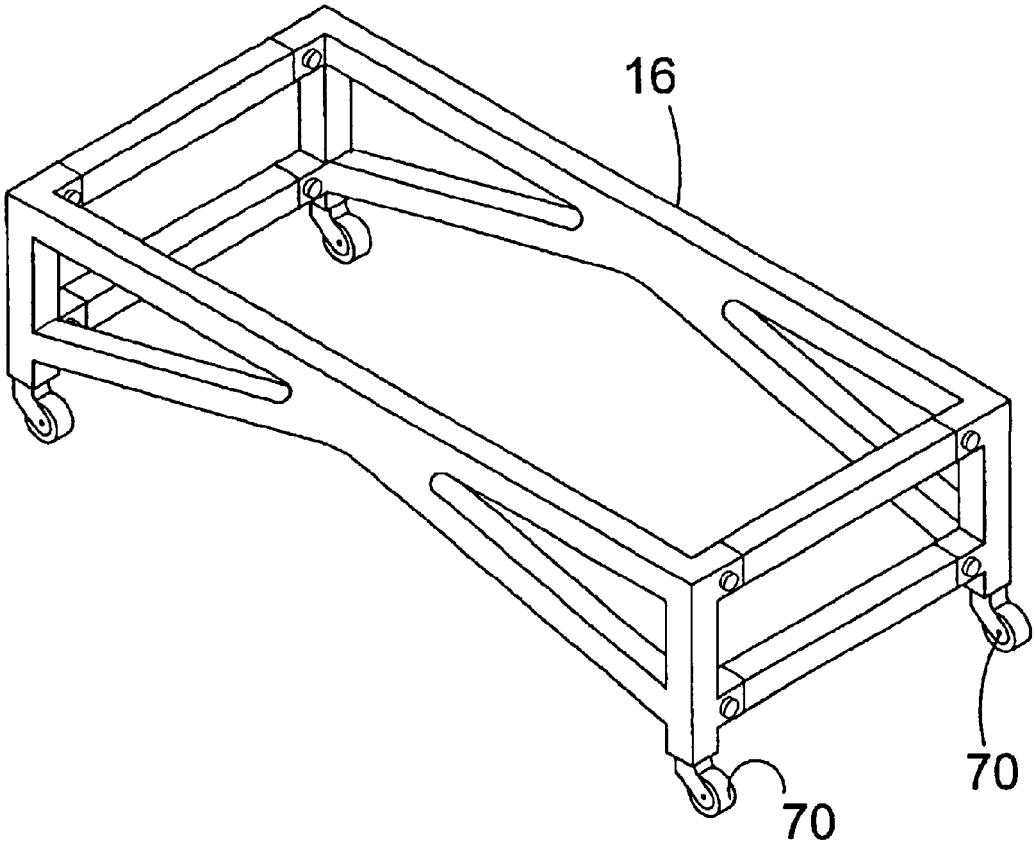
FIG. 7 is a perspective view of a gurney for use with the present invention.

Turning to FIG. 7, shown therein is a perspective view of the gurney 16 to be used with the present invention being an additional element comprising a gurney 16 with wheels 70 that can be used to support the bathing unit in situations where it is not feasible to place the unit on a bed or restricted by policy such as in a hospital.

I claim:

1. A portable bath for a patient, comprising:

a) a tub for holding water, said tub having a substantially horizontal bottom, two side walls, two end walls, said tub being open at the top;

b) wherein at least one sidewall is removably fixedly disposed on the tub to permit the patient to be easily placed thereon or removed therefrom;

c) a backrest/footrest disposed perpendicular to the longitudinal axis of the tub to receive the back or feet of the patient, said sidewalls having an inner surface and an outer surface, said inner surface having a plurality of substantially vertical grooves therein to receive a tongue of said backrest/footrest;

d) a headrest disposed on said tub to receive the head of the patient;

e) an inlet hose to permit water to be introduced into the tub;

f) a showerhead disposed on an end of the inlet hose with which to wash the patient;

g) a drain assembly disposed on said tub to permit removal of the used water from the tub;

h) an outlet hose to permit water to be carried from the drain assembly to a discharge point; and i) said backrest/footrest comprising a tongue member being disposed on each end thereof, each of said tongues for being slidably disposed in one of said grooves on each of said sidewalls.

2. The apparatus of claim 1, wherein said backrest/footrest has a front face and a rear face, wherein said front face is sloped to comfortably receive the back or feet of the patient.

3. The apparatus of claim 2, further comprising a plurality of latches for removably fixedly attaching said removable sidewall to said tub to permit a watertight seal to form between the removable sidewall and the tub.

4. The apparatus of claim 3, wherein said removable sidewall has a first end and a second end, further said tub having a first corner and a second corner for receiving said first and second ends of said sidewall in a mating relationship.

5. The apparatus of claim 4, wherein each of said ends of said sidewall have a vertical flange and a horizontal flange thereon, and each of said first and second corners of the tub have a vertical and a horizontal flange thereon to permit the vertical flanges of the sidewall and tub to mate and the horizontal flanges of the sidewall and tub to mate to permit fixed removal of the sidewall.

6. The apparatus of claim 5, wherein said vertical flanges of said sidewall mate with said vertical flanges of said first and second corner of the tub, and said horizontal flanges of said sidewall mate with said horizontal flanges of said first and second corners of the tub to permit fixed removal of the sidewall.

7. The apparatus of claim 6, further comprising a EPDM seal being disposed between said removable sidewall and said tub to permit a watertight seal thereinbetween.

8. The apparatus of claim 7, wherein said headrest is disposed on said backrest/footrest of the tub to receive the head of the patient.

9. The apparatus of claim 8, wherein said headrest is disposed on said end wall of the tub to receive the head of the patient.

10. The apparatus of claim 9, wherein hook and loop material is used to attach said headrest to the tub.

11. The apparatus of claim 10, further comprising a handgrip being disposed on each corner of said tub to permit a caregiver to grasp thereto.

12. The apparatus of claim 11, wherein said drain assembly further comprises a spigot disposed thereon to permit removal of water from the tub.

13. The apparatus of claim 12, wherein said showerhead further comprises a trigger to permit control of the flow of water therethrough.

14. The apparatus of claim 13, further comprising a wheeled gurney for receiving said bottom of said tub thereon to permit the tub to be moved about.

* * * * *